US006840787B2

(12) United States Patent
Adachi et al.

(10) Patent No.: US 6,840,787 B2
(45) Date of Patent: Jan. 11, 2005

(54) ROTATING CONNECTOR

(75) Inventors: Ryoichi Adachi, Tokyo (JP); Masatoshi Ushiyama, Tokyo (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 40 days.

(21) Appl. No.: 10/295,936

(22) Filed: Nov. 15, 2002

(65) Prior Publication Data

US 2003/0129867 A1 Jul. 10, 2003

(30) Foreign Application Priority Data

Dec. 26, 2001 (JP) ..... 2001-394990

(51) Int. Cl.[7] ..... H01R 3/00
(52) U.S. Cl. ..... 439/164; 439/15
(58) Field of Search ..... 439/164, 15, 13, 439/17

(56) References Cited

U.S. PATENT DOCUMENTS 6,409,527 B1 6/2002 Adachi

FOREIGN PATENT DOCUMENTS

JP 2001-112156 4/2001

*Primary Examiner*—Javaid H. Nasri
(74) *Attorney, Agent, or Firm*—Cohen, Pontani, Lieberman & Pavane

(57) ABSTRACT

A rotating connector 1 comprising a rotating case 2 and a stationary case 3 connected together in a manner that the rotating case 2 can rotate relative to the stationary case 3 and that an annular space S is formed inside, and a plurality of flat cables 6, 7 held in the annular space S. In the annular space S, the flat cables 6, 7 are wound like a swirl, being U-turned at about the middle thereof with the help of a roller 8 arranged in the space S, and fixed to the rotating case 2 at one end and the stationary case 3 at the other end. The rotating case 2 can rotate relative to the stationary case 3 a plurality of times, with the winding of flat cables 6, 7 being tightened or loosened. The flat cable 7 is smaller in thickness than the flat cable 6 which is U-turned by being directly guided by a U-turn roller 9. Thus, the flap noise which tends to be produced when the winding is tightened is reduced or prevented.

7 Claims, 3 Drawing Sheets

ROTATING CONNECTOR

BACKGROUND OF THE INVENTION

1. Related Application

This application claims priority from Japanese Patent Application No. 2001-394990 which is incorporated herein by reference.

2. Field of the Invention

The present invention relates to a rotating connector for transmitting electrical signals and/or optical signals between two members which rotate relative to each other.

3. Description of Related Art

A rotating connector is provided, for example, in a steering system of an automobile to electrically or optically connect an electronic circuit provided on a vehicle-body side and an electrical or electronic apparatus incorporated into a steering wheel to transmit electrical signals and/or optical signals and supply electric power.

In the rotating connector, a rotating case which is attached to a steering shaft and a stationary case which is attached to a steering column (vehicle body) are connected together in a manner that they can rotate relative to each other. Inside the connected cases is formed an annular space, in which a flat cable for transmitting electrical signals and/or optical signals is held.

As one type of the rotating connector, what is called a roller U-turn SRC (steering roll connector) is known, for example, from Japanese Unexamined Patent Publication No. 2001-112156 or U.S. Pat. No. 6,409,527B1. In the roller U-turn SRC, a ring-shaped member with a plurality of rollers is held in the above-mentioned annular space in a manner that it can move in the circumferential direction, and, for example, two flat cables are held in the annular space in a manner that they are wound like a swirl, each being U-turned at about the middle thereof with the help of one of the rollers, and fixed to the rotating case at one end and the stationary case at the other end.

The rollers are supported by the ring-shaped member which rotates in the annular space. The rollers guide the flat cables, which are tightened or loosened as the rotating case rotates, and help the flat cables U-turn.

When a rotating connector having flat cables U-turned at about the middle thereof as mentioned above is left in a high-temperature environment of, for example, about 85° C. or higher for two hours, the flat cables tend to remain curved. This tends to cause abnormal noise called flap noise, next time the rotating connector rotates. The thicker the flat cables, the more they remain curved.

SUMMARY OF THE INVENTION

The present invention provides a rotating connector, comprising: a first case being cylindrical in shape and having a first-case outer cylindrical wall face and a second case being cylindrical in shape and having a second-case inner cylindrical wall face, the first and second cases being connected together in a manner that one of the first and second cases can rotate relative to the other and that the first-case outer cylindrical wall face and the second-case inner cylindrical wall face face each other and define an annular space, said one of the first and second cases being to be fixed to a stationary member and said other thereof being to be attached to a rotating member;

a plurality of rotating rollers arranged in the annular space, with predetermined spaces between the rotating rollers, in a manner that the rotating rollers can rotate relative to the first and second cases, the rotating rollers including a U-turn guide roller;

a first flat cable held in the annular space and fixed to the first case at one end and the second case at the other end, the first flat cable being wound along the first-case outer cylindrical wall face in a manner that the first flat cable passes through a first gap formed between the first-case outer cylindrical wall face and each of the rotating rollers, then U-turned by being directly guided by the U-turn guide roller, and then wound along the second-case inner cylindrical wall face in a manner that the first flat cable passes through a second gap formed between the second-case inner cylindrical wall face and each of the rotating rollers; and a second flat cable held in the annular space in a manner that the second flat cable lies under the first flat cable, and fixed to the first case at one end and the second case at the other end. Here, the second flat cable is smaller in thickness than the first flat cable.

In the rotating connector according to the present invention, the first gap between the first case and each of the rollers and the second gap between the second case and each of the rollers are made as small as possible. Thus, flap noise can be prevented.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Embodiments of the invention will now be described with reference to the accompanying FIGS. 1 to 4, wherein like numerals refer to like elements throughout. The terminology used in the description presented herein is not intended to be interpreted in any limited or restrictive manner, simply because it is being utilized in conjunction with a detailed description of certain specific embodiments of the invention. Furthermore, embodiments of the invention may include several novel features, no single one of which is solely responsible for its desirable attributes or which is essential to practicing the invention herein described.

The inventors came to know that the smaller the clearance between each roller and the outer cylindrical face of the rotating case (hereinafter referred to as "rotating-case outer cylindrical face) and the clearance between each roller and the inner cylindrical face of the stationary case (hereinafter referred to as "stationary-case inner cylindrical face), the lower the sound pressure level of the flap noise produced when the rotating case rotates becomes.

However, since each flat cable has a predetermined thickness, the above-mentioned clearances cannot be made very small in order to lower the sound pressure. The lower limits of the two clearances are restricted by the number of turns for which the flat cables are wound onto the rotating case when tightened most and the number of turns for which the flat cables are wound onto the stationary case when loosened most, respectively. For example, when the clearance between each roller and the rotating case outer cylindrical face is small, the flat cables may not be able to be wound onto the rotating case for more than one turn, when the flat cables are tightened.

Further, when the clearances are too small, there is concern that the flat cables which remain curved will not smoothly pass through the clearances, and thus will not be able to be tightened or loosened normally.

If the flat cables are too thin, the flat cables cannot have sufficient tensile strength. In addition, when loosened, the flat cables cannot be sent out smoothly.

Thus, regarding conventional rotating connectors, there is a limit to how smaller the clearances can be, and hence a limit to how much the sound pressure level of the flap noise can be lowered.

A rotating connector 1 according to the present invention is suited to be attached to a steering system of an automobile. The rotating connector 1 comprises an inner case or rotating case 2, an outer case or stationary case 3, a first flexible flat cable (FFC) 6 and a second flexible flat cable (FFC) 7. The rotating case 2 and the stationary case 3 are both molded from synthetic resin such as polybutylene terephthalete (PBT), polyacetal (POM), polypropylene (PP), or the like.

Figure 2:
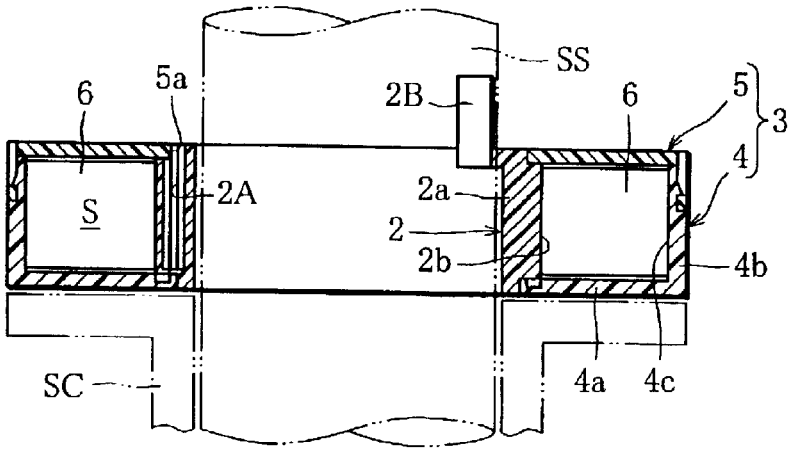
FIG. 2 is a cross-sectional view taken along line II—II of FIG. 1.

As shown in FIG. 2, the rotating case 2 comprises a cylindrical member 2*a*. A part of each FFC 6, 7, namely, a part following an end (inner end) of each FFC 6, 7 is wound along the outer cylindrical wall face 2*b* of the cylindrical member 2*a* to be supported by the cylindrical member 2*a*. The outer cylindrical wall face 2*b* defines an annular space S (described later). The outer cylindrical wall face 2*b* has a recess, in which a connection part 2A for fixing the inner end of each FFC 6, 7 is provided. A pin 2B projecting upward in FIG. 2 is provided at an upper part of the rotating case 2. The pin 2B engages with an engagement part (not shown in detail) of the steering system to thereby transmit rotation of a steering shaft (rotating member) SS depicted by chain double-dashed lines in FIG. 2 to the rotating case 2 to make the rotating case 2 rotate with the steering shaft SS, around the axis of the shaft SS.

Figure 1:
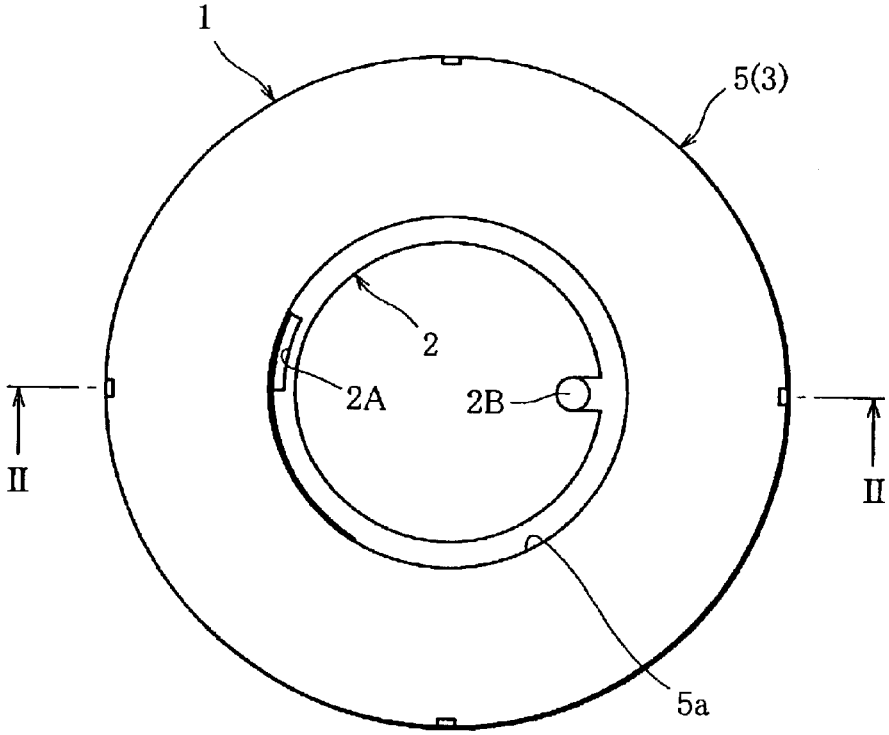
FIG. 1 is a plan view schematically showing an embodiment of a rotating connector according to the present invention.
Figure 3:
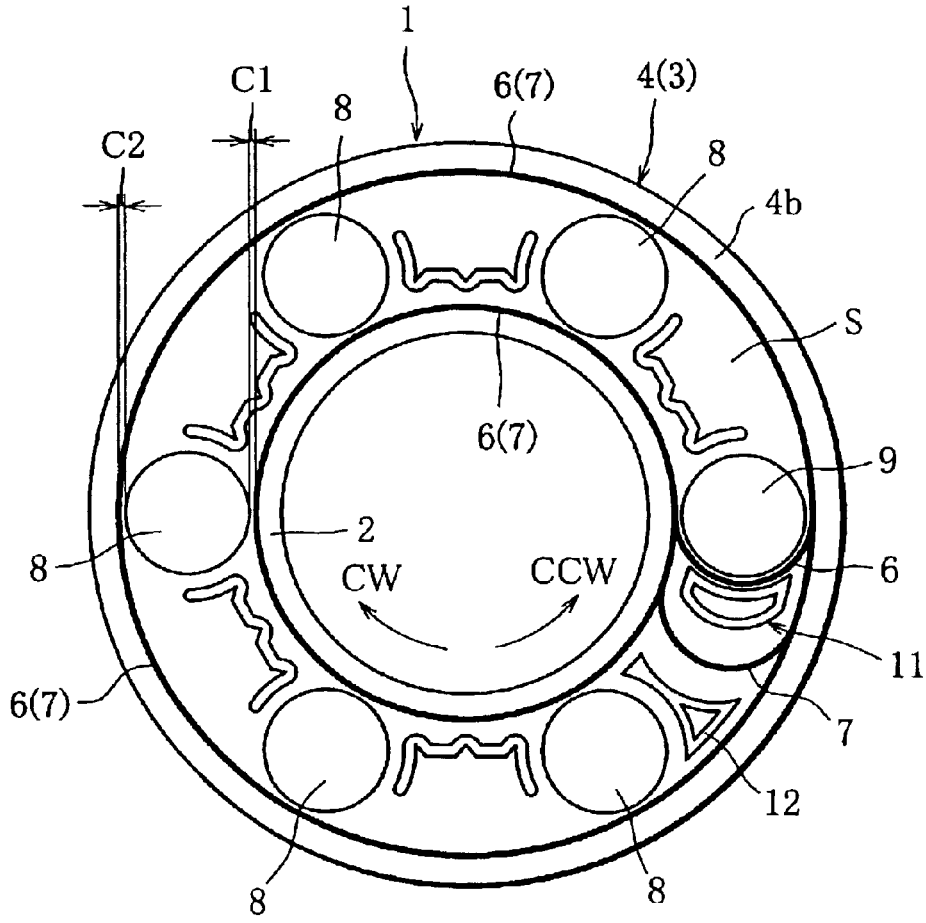
FIG. 3 is a plan view showing the rotating connector of FIG. 1 from which a cover is removed to show an annular space.

The stationary case 3 is fixed to a steering column SC (depicted by chain double-dashed lines in FIG. 2) which is a stationary member. As shown in FIGS. 1 to 3, the stationary case 3 comprises an outer cylindrical member 4 and a cover 5. The stationary case 3 and the rotating case 2 are connected together in a manner that the rotating case 2 can rotate relative to the stationary case 3. Between both cases is formed an annular space S, in which the FFCs 6 and 7 are held.

The outer cylindrical member 4 comprises a ring plate 4*a* which forms a bottom, and an outer cylindrical part 4*b* which is formed integrally on the outer circumference of the ring plate 4*a*. The inner cylindrical wall face 4*c* of the outer cylindrical member 4 faces the outer cylindrical wall face 2*b* of the rotating case. Also the inner cylindrical wall face 4*c* defines the annular space S. A part of each FFC 6, 7, namely, a part following the other end (outer end) of each FFC 6, 7 is wound along the inner cylindrical wall face 4*c*. The inner cylindrical wall face 4*c* has a connection part for fixing the outer end of each FFC 6, 7, which is similar to the connection part 2A of the rotating case.

The cover 5 is a ring-shaped member having an opening 5*a* in the center. The diameter of the opening 5*a* is about the same as the outer diameter of the rotating case 2.

In the annular space S, a plurality (5) of rotating rollers 8 and a U-turn roller 9, which is the same in shape as the rotating rollers 8, are disposed on a circumference with predetermined spaces between them. (The spaces may be equal in size but does not need to be equal in size. In summary, the respective sizes of the spaces can be determined as desired.) The rotating rollers 8 and the U-turn roller 9 keep predetermined distances between them, and they are all supported by a carrier (not shown) in a manner that they can each rotate. The carrier can rotate with the rollers 8 and 9, relative to the first case 2 and the stationary case 3, around the axis of the steering shaft SS.

The clearance C1 between the rotating-roller outer cylindrical wall face 2*b* and each roller 8, 9 and the clearance C2 between the stationary-roller inner cylindrical wall face 4*c* and each roller 8, 9 (shown in FIG. 3) are kept constant. The rollers 8 and 9 function as guides which help wind the FFCs 6 and 7 onto the rotating case 2 or the stationary case 3 when the FFCs 6 and 7 are tightened or loosened. Further, the U-turn 9 functions as a guide which helps the FFCs 6 and 7 U-turn at about the middle thereof smoothly.

As shown in FIG. 3, a first guide piece 11 is provided beside the U-turn roller 9. The guide piece 11 has a circular-arc side face which faces the U-turn roller 9 with a predetermined space between. Also the guide piece 11 is supported by the above-mentioned carrier which supports the rollers 8 and 9. Thus, with the carrier, the guide piece 11 can rotate relative to the rotating case 2 and the stationary case 3, around the axis of the steering shaft SS. The FFC 6 is passed through between the U-turn roller 9 and the guide piece 11. When the FFC 6 is tightened or loosened, the guide piece 11 can keep the FFC 6 in close contact with the U-turn roller 9. Thus, the guide piece 11 helps prevent flap noise, and also guides the FFC 6 so that the FFC 6 may be tightened or loosened smoothly.

Between the first guide piece 11 and the rotating roller 8 which faces the U-turn roller 9 with the first guide piece 11 between, closer to the rotating roller 8, a second guide piece 12 is provided. Also the guide piece 12 is supported by the above-mentioned carrier which supports the rollers 8 and 9. The second FFC 7 is passed through a space between the guide pieces 11 and 12 and U-turned. The guide pieces 11 and 12 function as guides which helps the FFC 7 U-turn.

How the carrier supports the rollers 8 and 9 is not restricted to any particular manner, and irrelevant to the essence of the present invention. Hence, the explanation thereof will be omitted, only mentioning that U.S. Pat. No. 6,409,527 B1 shows an example.

Each of the FFCs 6 and 7 comprises, for example, a plurality of conductors and/or a plurality of optical fibers arranged in parallel and an insulating coating which covers those conductors and/or optical fibers, and has appropriate flexibility. As mentioned above, the FFCs 6 and 7 are held in the annular space S, being laid one over the other and wound along the rotating-case outer cylindrical wall face 2*b* and the stationary-case inner cylindrical wall face 4*c*, like a swirl.

More specifically, the FFCs 6 and 7 are fixed to the connection part 2A of the rotating case by their inner ends, and wound along the outer cylindrical wall face 2*b* for a required number of turns in a state that they are laid one over the other. Here, in each turn, the FFC 6 lies over the FFC 7. When wound along the outer cylindrical wall face 2*b*, the FFCs 6 and 7 is passed through the clearance C1 between the rotating-case outer cylindrical wall face 2*b* and each roller 8 and 9. Then, the FFC 6 is separated from the FFC 7, passed through the clearance between the U-turn roller 9 and the guide piece 11, and U-turned with the help of the U-turn roller 9. Meanwhile, the FFC 7 is passed through the space between the guide pieces 11 and 12 and U-turned. Then, the FFCs 6 and 7 are wound along the stationary-case inner cylindrical wall face 4*c* for a required number of turns in a state that they are laid one over the other again. When wound along the stationary-case inner cylindrical wall face 4*c*, the FFCs 6 and 7 are passed through the clearance C2 between the stationary-case inner cylindrical wall face 4*c* and each roller 8, 9. Finally, the outer ends of the FFCs 6 and 7 reach the connection part provided at the stationary-case inner cylindrical wall face 4*c*.

As is clear from the above description, the FFCs 6 and 7 are U-turned following different routes. Thus, the entire length of the FFC 6 is made shorter than the entire length of the FFC 7. While the described embodiment includes a single second FFC 7, it is possible to provide a plurality of second FFCs 7. In that case, the FFC 6 has a shorter entire length than any of the FFCs 7.

In the present invention, the thickness of any second FFC 7 is made thinner than that of the FFC 6. Depending on the thicknesses of the FFCs 6 and 7 and the required number of turns of the FFCs (which corresponds to the required number of turns of the rotating connector), the size of the clearance C1 between the rotating-case outer cylindrical wall face 2*b* and each roller 8, 9 and the size of the clearance C2 between the stationary-case inner cylindrical wall face 4*c* and each roller 8, 9 are determined to be as small as possible. Since the thickness of any second FFC 7 is made thinner than that of the FFC 6, the clearances C1 and C2 can be smaller as compared with conventional rotating connectors. The thickness of the FFCs wound on the rotating case 2 becomes largest when the rotating connector takes the limit position in one direction of rotation (counterclockwise or clockwise direction), while the thickness of the FFCs wound on the stationary case 3 becomes largest when the rotating connector takes the limit position in the opposite direction of rotation. Since the largest thickness of the FFCs wound on the rotating case 2 is necessarily larger than the largest thickness of the FFCs wound on the stationary case 3, the clearance C1 is made larger than the clearance C2.

The rotating connector 1 having the above-described structure is set up as follows: First, the FFCs 6 and 7 are wound like a swirl, where the FFCs 6 and 7 are U-turned at about the middle thereof, using the U-turn roller 9. Then, the inner ends of the FFCs 6 and 7 are fixed to the connection part 2A, while the outer ends thereof are fixed to the outer cylindrical member 4. Then, in the annular space S between the cases 2 and 3, the FFCs 6 and 7 thus wound are arranged in an intermediate state between the most tightened state and the most loosened state. Then, the cases 2 and 3 thus set up are attached to the steering system.

In the rotating connector 1, the rotating case 2 can rotate relative to the stationary case 3 for the number of turns which depends on the lengths of the FFCs 6 and 7. In other words, the rotating case 2 can rotate both left and right (counterclockwise and clockwise), from an intermediate position which corresponds to the above-mentioned intermediate state to each rotation-limit position which depends on the lengths of the FFCs 6 and 7.

When the rotating case 2 rotates counterclockwise (in the CCW direction shown by an arrow in FIG. 3), the FFC 6 is tightened and wound onto the rotating case 2, keeping in direct contact with the circumference of the U-turn roller 9. At that time, the FFC 6 exerts pressure on the U-turn roller 9, which makes the carrier which supports the U-turn roller 9 rotate counterclockwise with the rollers 8 and 9. With this rotation, also the FFC 7 is wound onto the outer cylindrical wall face 2*b* of the rotating case 2. Thus, the FFC 7 and FFC 6 are wound onto the outer cylindrical wall face 2*b* of the rotating case 2 in this order as viewed in the radial direction.

When the rotating case 2 rotates clockwise (in the CW direction shown by an arrow in FIG. 3), the FFC 6 is loosened. Thus, the FFC 6 is sent out from the rotating case 2 through between the U-turn roller 9 and the guide piece 11 and wound along the inner cylindrical wall face of the stationary case 3. Here, due to the rigidity and elasticity of the FFC 6, the FFC 6 is wound along the inner cylindrical wall face of the stationary case 3, keeping close contact with the inner cylindrical wall face of the stationary case 3. When the FFC 6 is sent out, the FFC 6 also exerts pressure on the side face of the guide piece 11, due to its elasticity. This makes the carrier which supports the guide piece 11 rotate clockwise with the rollers 8 and 9.

As stated above, as the rotating case 2 rotates, the FFC 6 exerts pressure on the U-turn roller 9 and the guide piece 11. Thus, the FFC 6 receives tractive force as reaction force. In contrast, the FFC 7 is wound onto the outer cylindrical wall face of the rotating case 2 or the inner cylindrical wall face of the stationary case 3, being covered with the FFC 6. Thus, the FFC 7 is sent in or out with the help of friction between the FFC 6 and the FFC 7. Thus, the FFC 7 does not need to have as large rigidity and elasticity as the FFC 6 needs to have.

Since the FFC 7 does not directly touch any of the rotating rollers 8, the U-turn roller 9 and the guide piece 11, the FFC 7 receives almost no external force from any of the rotating rollers 8, the U-turn roller 9 and the guide piece 11.

Thus, in the rotating connector 1, weight should be put on the durability of the FFC 6 which touches the U-turn roller 9 and the guide piece 11 and receives external force therefrom. The requirement on the durability of the FFC 7 is not so high as the requirement on the durability of the FFC 6. In other words, the thickness of the FFC 7 can be made smaller. This leads to another advantage that the FFC 7 has a smaller tendency to remain curved in a high-temperature environment.

Thus, the rotating connector 1 can be designed on the premise that when the number of turns is the same, the thickness of the FFCs 6 and 7 wound on the case 2 and the thickness of the FFCs 6 and 7 wound on the case 3 are smaller as compared with conventional rotating connectors. Hence, the rotating connector 1 can have smaller clearances C1 and C2 as compared with conventional rotating connectors, which helps reduce or prevent flap noise.

As stated above, in the annular space S formed between the cases 2 and 3, the FFCs 6 and 7, which are wound like a swirl, being U-turned at about the middle thereof, are sent from the outer cylindrical wall face of the rotating case 2 to the inner cylindrical wall face of the stationary case 3 or vice versa, being guided by the U-turn roller 9 and the guide piece 11.

In the above-described embodiment, the guide piece 11 is provided so that the FFCs 6 and 7 can be smoothly wound onto the inner cylindrical wall face of the stationary case 3 when the rotating case 2 rotates clockwise, i.e., when the FFCs 6 and 7 are loosened. However, the guide piece 11 can be omitted by taking another design. For example, if the FFC 6 has a larger rigidity, the guide piece 11 can be omitted, though a larger rigidity leads to a larger thickness. Further, the guide piece 12 can be omitted depending on circumstances, though the guide piece 12 helps guide the FFC 7 more smoothly.

Next, examples of thicknesses of FFCs and clearances in the described embodiment will be mentioned.

The length of the FFCs and the number of turns for which the FFCs are wound when tightened or loosened are related to each other. Thus, the number of turns for which the FFCs 6 and 7 are wound when tightened most and the number of turns for which the FFCs 6 and 7 are wound when loosened most are determined in advance.

Then, the clearances C1 and C2 and the thicknesses of the FFCs 6 and 7 are determined to be optimal. In FIG. 3, because of the difference of the diameters of the turns, the number of turns for which the FFCs are wound onto the outer cylindrical wall face of the rotating case 2 when tightened most is necessarily larger than the number of turns for which the FFCs are wound onto the inner cylindrical wall face of the stationary case 3 when loosened most. Taking this into consideration, the clearances C1 and C2 and the FFCs 6 and 7 are designed to be optimal.

Experiments were carried out following the above-mentioned guideline, and it was found out that when the thickness of the FFC 6 was 0.195 mm, the thickness of the FFC 7 was able to be reduced to 0.125 mm by reducing the thickness of the coating of the FFC 7, without inviting damage to the FFC 7 during the practical operation of the rotating connector 1.

Further, it was found out that that when the thickness of the FFC 6 was as mentioned above, the diameter of the inner cylindrical wall face of the stationary case 3 of the rotating connector 1, the diameter of the outer cylindrical wall face of the rotating case, the diameter of each rotating roller 8, 9, the clearance C1 and the clearance C2 were able to be 82.6 mm, 49 mm, 14.85 mm, 1.15 mm and 0.8 mm, respectively.

In this case, for example, when the FFCs 6 and 7 are wound for two turns, the thickness of the FFCs 6 and 7 thus wound is 0.64 mm. Since this thickness is smaller than the clearance C2 of 0.8 mm, this design is thought to allow the FFCs 6 and 7 to be wound onto the stationary case 3 when the FFCs 6 and 7 are loosened.

Five of the rotating connectors designed as above (embodiments) and five of conventional rotating connectors having FFCs 7 and 6 of the same thickness (comparative examples) were left in an environment of 90° C. for about 2 hours. After that, the sound pressure level of flap noise was measured under the same mounting conditions. It was found out that in the rotating connectors 1 prepared as embodiments, the sound pressure level of flap noise was reduced by 3 to 4 dB, i.e., about 50% to 40%, as compared with the rotating connector prepared as comparative examples.

While the above-described embodiment of a rotating connector comprises two FFCs 6 and 7, the number of FFCs is not restricted to two. It can be three, four or more. Namely, the number of FFCs used in a rotating connector can be chosen to be any more than one, depending on the purpose of use of the rotating connector. It goes without saying that in that case, a first FFC which directly touches the U-turn roller needs to be smaller in entire length and larger in thickness than the other (second) FFCs.

While the above-described embodiment of a rotating connector comprises a single U-turn roller, the rotating connector may comprise more than one U-turn roller for U-turning a FFCs.

Figure 4:
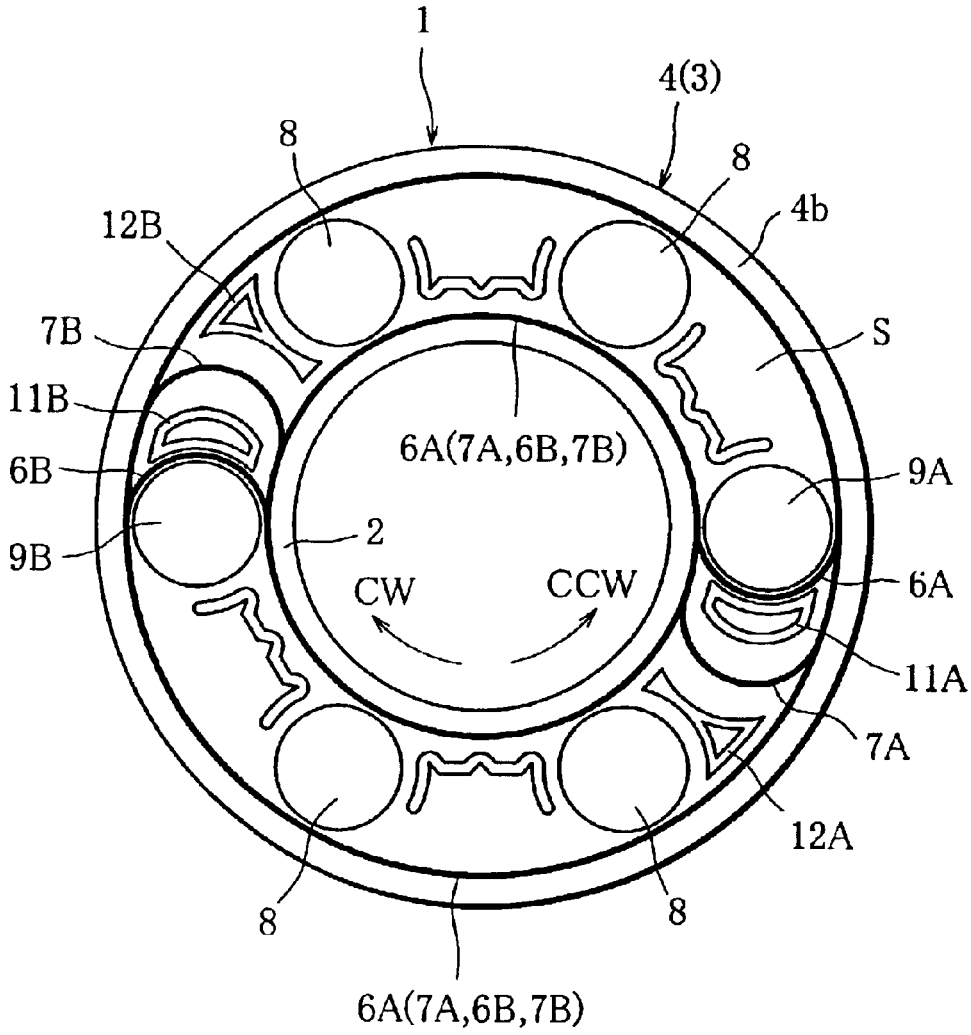
FIG. 4 is a plan view showing another embodiment of a rotating connector according to the present invention, in a manner like FIG. 3.

FIG. 4 shows an example of modification to the above-described embodiment.

In FIG. 4, in the annular space S, a first U-turn roller 9A and a second U-turn roller 9B are provided in symmetrical positions. A first guide piece 11A and a second guide piece 11B are provided beside the first U-turn roller 9A and the second U-turn roller 9B, respectively. A first FFC 6A is passed through between the first U-turn roller 9A and the guide piece 11A so that it can directly touch the first U-turn roller 9A, while another first FFC 6B is passed through between the second U-turn roller 9B and the guide piece 11B so that it can directly touch the second U-turn roller 9B. Each of the first FFCs 6A and 6B is fixed to the rotating case 2 at one end, and the stationary case 3 at the other end. The explanation of the other components such as second FFCs 7A and 7B will be omitted, since they can be easily understood from the above-described embodiment. Those components are denoted by the same reference numerals as used in the above-described embodiment.

In this example of modification, when the rotating case 2 rotates counterclockwise, the FFC 6A and FFC 6B make the U-turn rollers 9A and 9B rotate counterclockwise. When the rotating case 2 rotates clockwise, the FFC 6A and FFC 6B press the guide pieces 11A and 11B and make them rotate clockwise.

In the above-described embodiment, the rotating connector was supposed to be attached to a steering system of an automobile, and an inner case arranged on the center side of the rotating connector was a rotating case attached to a rotating member. However, an outer case arranged on the outer side of the rotating connector may be a rotating case attached to a rotating member. In other words, it is possible to arrange a stationary case in the center of a rotating connector, and arrange a rotating case outside the stationary case.

What is claimed is:

1. A rotating connector, comprising:

a first case being cylindrical in shape and having a first-case outer cylindrical wall face and a second case being cylindrical in shape and having a second-case inner cylindrical wall face, said first and second cases being connected together in a manner that one of said first and second cases can rotate relative to the other and that said first-case outer cylindrical wall face and said second-case inner cylindrical wall face face each other and define an annular space, said one of first and second cases being to be fixed to a stationary member and said other thereof being to be attached to a rotating member;

a plurality of rotating rollers arranged in said annular space, with predetermined spaces between said rotating rollers, in a manner that said rotating rollers can rotate relative to said first and second cases, said rotating rollers including a U-turn guide roller;

a first flat cable held in said annular space and fixed to said first case at one end and said second case at the other end, said first flat cable being wound along said first-case outer cylindrical wall face in a manner that said first flat cable passes through a first gap formed between said first-case outer cylindrical wall face and each of said rotating rollers, then U-turned by being directly guided by said U-turn guide roller, and then wound along said second-case inner cylindrical wall face in a manner that said first flat cable passes through a second gap formed between said second-case inner cylindrical wall face and each of said rotating rollers; and a second flat cable held in said annular space in a manner that said second flat cable lies under said first flat cable, and fixed to said first case at one end and said second case at the other end, said second flat cable being smaller in thickness than said first flat cable.

2. The rotating connector according to claim 1, comprising a plurality of said second flat cables.

3. The rotating connector according to claim 2, wherein said first flat cable is smaller in length than any of said second flat cables.

4. The rotating connector according to claim 1, further comprising a first guide piece arranged beside said U-turn guide roller with a predetermined space between, in a manner that said first guide piece can rotate relative to said first and second cases, wherein at least said first flat cable passes through between said U-turn guide roller and said first guide piece.

5. The rotating connector according to claim 1, further comprising a second guide piece arranged between said U-turn guide roller and a rotating roller next to said U-turn guide roller, with predetermined spaces relative to said U-turn guide roller and said rotating roller, in a manner that said second guide piece can rotate relative to said first and second cases, wherein said second flat cable is U-turned by being guided by said second guide piece.

6. The rotating connector according to claim 1, comprising a plurality of said U-turn guide rollers and as many of said first flat cables, wherein each of said first flat cables is U-turned by being directly guided by a corresponding one of said U-turn guide rollers.

7. The rotating connector according to claim 6, comprising a plurality of said second flat cables, wherein said second flat cables are held in said annular space in a manner that each of said second flat cable lies under any of said first flat cable.

* * * * *